US007225882B2

(12) United States Patent
Miller et al.

(10) Patent No.: US 7,225,882 B2
(45) Date of Patent: Jun. 5, 2007

(54) METHOD AND APPARATUS FOR RETARDING FIRE

(76) Inventors: John C. Miller, 2274 W. Dovewood La., Fresno, CA (US) 93711; Deborah L. Miller, 2274 W. Dovewood La., Fresno, CA (US) 93711

( * ) Notice: Subject to any disclaimer, the term of this patent is extended or adjusted under 35 U.S.C. 154(b) by 155 days.

(21) Appl. No.: 10/757,705

(22) Filed: Jan. 14, 2004

(65) Prior Publication Data

US 2005/0150664 A1 Jul. 14, 2005

(51) Int. Cl.
*A62C 2/00* (2006.01)

(52) U.S. Cl. ..... 169/45; 169/46; 169/48; 169/49; 169/50; 169/54; 52/3; 428/921; 442/302; 442/414

(58) Field of Classification Search ..... 169/45, 169/46, 48, 49, 50, 54, 70; 52/1, 3, 5, DIG. 12; 428/920, 921; 252/2, 3, 8.05; 442/301, 442/302, 402, 414, 415; 454/168–170
See application file for complete search history.

(56) References Cited

U.S. PATENT DOCUMENTS 2,720,269 A * 10/1955 Diacos ..... 169/50
4,212,920 A 7/1980 Seamans
4,510,081 A 4/1985 Bronner et al.
4,610,311 A 9/1986 Bronner et al.
4,992,481 A 2/1991 von Bonin et al.
5,083,617 A * 1/1992 Pierce, Jr. ..... 169/50
5,099,532 A 3/1992 Thomas et al.
5,103,816 A 4/1992 Kirschbaum et al.
5,190,810 A 3/1993 Kirschbaum et al.
5,225,236 A 7/1993 Keusch et al.
5,230,959 A 7/1993 Young, Sr. et al.
5,324,578 A 6/1994 Weinburg
5,608,992 A * 3/1997 Floyd ..... 52/3
5,849,210 A 12/1998 Pascente et al.
5,885,912 A 3/1999 Bumbarger
6,319,573 B1 * 11/2001 Lokken ..... 169/48
6,371,977 B1 4/2002 Bumbarger et al.
6,521,362 B2 2/2003 Koeppen
6,742,305 B2 * 6/2004 Rogers et al. ..... 52/3
6,806,215 B2 * 10/2004 Grilliot et al. ..... 442/414

OTHER PUBLICATIONS

Precision Lift Inc. "Fire Blocking Gel" website, www.precision.rotor.com/trialpgs/gel.shtml. Accessed Dec. 5, 2003.

* cited by examiner

*Primary Examiner*—Steven J. Ganey
(74) *Attorney, Agent, or Firm*—Joan I. Norek

(57) ABSTRACT

A barrier for retarding fire comprises water-permeable fabric for covering a substantial area, the fabric having at least 9 pockets per square foot, each pocket having a volumetric capacity of between about 0.03 cubic inches and about 17 cubic inches, wherein substantially all of the pockets contain between about 0.01 and about 2 grams of superabsorbent polymer per cubic inch of volumetric capacity of the pockets.

29 Claims, 4 Drawing Sheets

METHOD AND APPARATUS FOR RETARDING FIRE

BACKGROUND OF THE INVENTION

1. Field of the Invention

The present invention is directed to an apparatus and method for retarding fire, particularly to a fire-retardant barrier for retarding fire from burning a building.

2. Description of the Related Art

Wildfires are known periodically to threaten residential areas and damage or destroy homes. Typically, home owners have significant warning as to the likelihood of a fire passing through their residential area so that preventative steps can be taken to avoid damage.

Water has been known for millennia for its ability to prevent or extinguish fires due to its high heat capacity and high heat of vaporization. One method that has been used for retarding fire from burning a building is spraying water on the roof and exterior walls of a building. However, this method is not particularly effective because water tends to flow off the building, limiting the amount of water that can be placed on and adhered to the building's surfaces. Water also tends to evaporate quickly, especially in the heat of a fire. Covering a building with a tarp able to absorb water is also known, see U.S. Pat. No. 6,521,362.

It has been reported that foams or superabsorbent polymer gels formed by adding water to superabsorbent polymer powders have been used as a fire-retardant. However, forming and applying the foam or gel requires special equipment. Only limited amounts of gel or foam can be placed on a surface before the gel or foam begins to slough off. The gels and foams also can require significant cleanup after a fire has passed. Also, the concentrated polymers used to form gels typically are flammable, so that storage of the concentrated polymers can be hazardous.

Superabsorbent polymers have also been used for protection in extreme temperature situations, see U.S. Pat. No. 5,885,912 for a "Protective Multi-Layered Liquid Retaining Composite."

What is needed is a method that provides effective retardation of a fire and an apparatus for retarding fire that is easy and safe to store, easy to apply to an object, and that is easy to clean up after a fire has passed.

BRIEF SUMMARY OF THE INVENTION

A barrier for retarding fire from burning an object is provided having water-permeable fabric for covering a substantial area, the fabric having at least 9 pockets per square foot, each pocket having a volumetric capacity of between about 0.03 cubic inches and about 17 cubic inches, wherein substantially all of the pockets contain between about 0.01 and about 2 grams of superabsorbent polymer per cubic inch of volumetric capacity of the pockets.

In one embodiment, a barrier for retarding fire is provided having a plurality of pockets connected together to cover a substantial area, wherein each one of the plurality of pockets has a pair of fabric layers, wherein at least one of the fabric layers is water-permeable, and a cavity disposed between the fabric layers, the cavity having a capacity of between about 0.03 cubic inches and about 17 cubic inches, wherein substantially all of the plurality of pockets hold between about 0.01 and about 2 grams of a superabsorbent polymer per cubic inch of volumetric capacity.

A method of retarding fire from burning an object is also provided including the steps of providing a plurality of fire-retardant barriers, each having water-permeable fabric, the fabric having at least 9 pockets per square foot, each pocket having a volumetric capacity of between about 0.03 cubic inches and about 17 cubic inches, wherein substantially all of the pockets contain between about 0.01 and about 2 grams of superabsorbent polymer per cubic inch of volumetric capacity of the pockets, covering substantially all of the object with the plurality of fire-retardant barriers, and hydrating the superabsorbent polymer in each one of the plurality of fire-retardant barriers.

These and other features and advantages are evident from the following description of the present invention, with reference to the accompanying drawings.

DETAILED DESCRIPTION OF THE INVENTION

Figure 1:
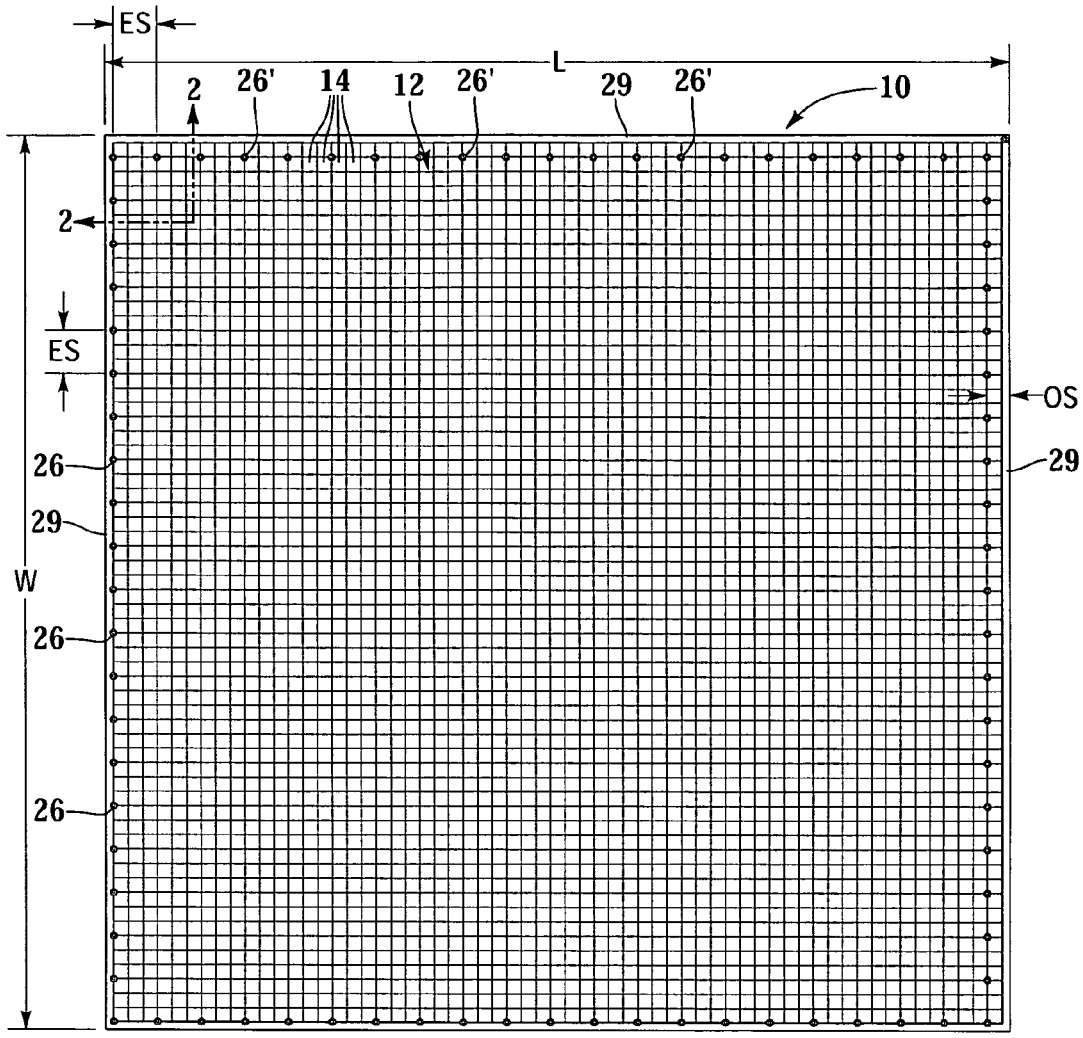
FIG. 1 is an elevation view of a fire-retardant barrier.

Referring to FIGS. 1, 2, 3, and 9, a fire-retardant barrier 10 is shown for retarding fire, preferably for retarding fire from burning an object, such as a building or other structure 2. Fire-retardant barrier 10 includes water-permeable fabric 12 for covering a substantial area, wherein fabric 12 has at least 9 pockets 14 per square foot, each pocket 14 having a volumetric capacity of between about 0.03 cubic inch and about 17 cubic inches, wherein substantially all of pockets 14 contain between about 0.01 grams and about 2 grams of superabsorbent polymer 16 per cubic inch of volumetric capacity of pockets 14.

A fire requires three components, fuel, oxygen, and heat energy sufficient to ignite the fuel. If any one of these components is removed, a fire will not burn. Fire-retardant barrier 10 isolates an object (the fuel) from the flames 40 (ignition heat) and from oxygen to retard the flames 40 from burning the object. Barrier 10 uses the most effective and economical substance used for fire prevention, i.e. water, by incorporating it into an easy-to-use apparatus.

Barrier 10 is designed for use in protecting an object or structure 2, such as a house or other building, but it is envisioned that barrier 10 can be used to protect other objects, such as automobiles, trees, shrubs and other plants, as a firebreak to prevent the spread of a fire, or for extinguishing fires, such as a cover for ensuring camp fires are smothered, or for isolating and extinguishing petroleum or other chemical fires. For purposes of clarity, fire-retardant barrier 10 is described for use in retarding fire from burning structure 2, however, it is envisioned that fire-retardant barrier 10 can be used as a firebreak or other fire-retarding apparatus.

Barrier 10 holds water in a matrix so that the water is more effective in retarding fire. Barrier 10 uses the high heat capacity and the high heat of vaporization of water to temporarily prevent structure 2 from reaching a temperature high enough to burn. Barrier 10 absorbs a large amount of water in a superabsorbent material, preferably a superabsorbent polymer 16 that is hydrated with a large amount of water. When a fire encounters structure 2, the water absorbed in barrier 10 disperses a large amount of heat from the fire by volatilizing the water to form steam. As the steam is formed, the temperature of the flames is lowered, thus reducing the heat available to propagate the fire. Additionally, the temperature of barrier 10 will not exceed the boiling point of water until all of the water is evaporated, so that barrier 10 cannot reach a temperature that is high enough to ignite.

Figure 6:
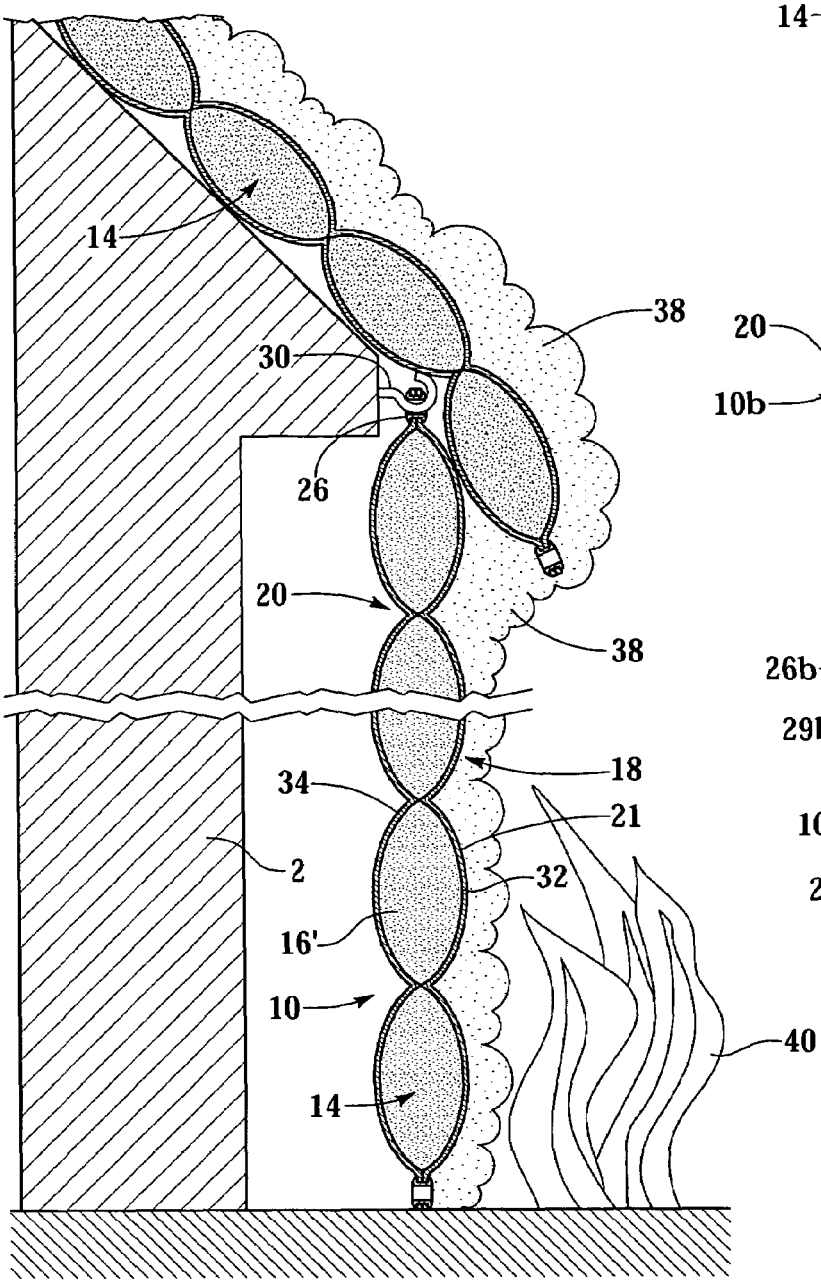
FIG. 6 is a side-sectional view of the fire-retardant barrier fastened to a structure, wherein a fire is present adjacent to the structure.

In addition to absorbing heat from the fire, the steam formed by volatilizing the water absorbed in barrier 10 creates a steam layer 38 at the outer surface 21 of barrier 10, see FIG. 6. Steam layer 38 acts as a fire extinguisher by depriving the fire of oxygen at surface 21 of barrier 10, thus quenching any flames that attempt to form at surface 21. The steam that forms steam layer 38 is continually replenished during a fire because the large amount of water absorbed by superabsorbent polymer 16 is continuously volatilized to form steam layer 38 until all of the water absorbed by superabsorbent polymer 16 is exhausted. Steam layer 38 will continue to protect surface 21 of barrier 10 until all the water is vaporized, or until the fire passes away from structure 2. The formation of steam layer 38 not only aides in retarding fire from burning the object being protected, such as structure 2 (FIG. 9), but also acts to self-protect barrier 10 from burning.

Because barrier 10 is designed to hold a large amount of water in superabsorbent polymer 16, a typical flash fire will burn past structure 2 before all the water in barrier 10 can be evaporated.

FIRE-RETARDANT BARRIER

Fire-retardant barrier 10 is made from water-permeable fabric 12 and is designed to cover a substantial portion of structure 2, wherein fabric 12 holds superabsorbent polymer 16 in a matrix so that barrier 10 can absorb a large amount of water. Because a large area may have to be covered by one or more fire-retardant barriers 10, ease of installation and handling of barrier 10 may be a consideration depending on the application. For this reason, barrier 10 may be fabricated to have a size that is easy to manipulate.

Turning back to FIG. 1, barrier 10 may be generally rectangular in shape having a length L and a width W to cover a total area of length L multiplied by length W. In one embodiment, length L is between about 5 feet and about 50 feet, preferably between about 10 feet and about 30 feet, still more preferably about 20 feet, and width W is between about 5 feet and about 50 feet, preferably between about 10 feet and about 30 feet, still more preferably about 20 feet so that barrier 10 covers an area of between about 25 square feet and about 2500 square feet, preferably between about 100 square feet and about 900 square feet, still more preferably about 400 square feet. Barrier 10 may be made slightly larger than the area that is desired to be covered to allow for overlap between barrier 10 and adjacent fire-retardant barriers. The specific dimensions of fire-retardant barrier 10 can vary substantially depending on the actual application barrier 10 is being used for, such as for a firebreak or to cover a structure 2.

Barrier 10 may include a plurality of pockets or segments 14 to form the matrix of fabric 12 and superabsorbent polymer 16. A predetermined amount of superabsorbent polymer 16 is placed in each pocket 14, described below, to absorb a predetermined amount of water. In one embodiment, there are between about 9 and about 600, preferably between about 16 and about 150, still more preferably about 36 pockets per square foot of barrier 10.

Figure 3:
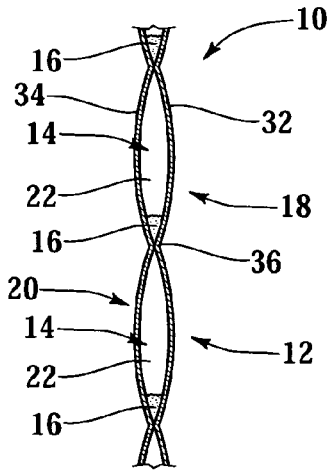
FIG. 3 is a side-sectional view of the fire-retardant barrier which is not hydrated, taken along line 3-3 in FIG. 2.
Figure 4:
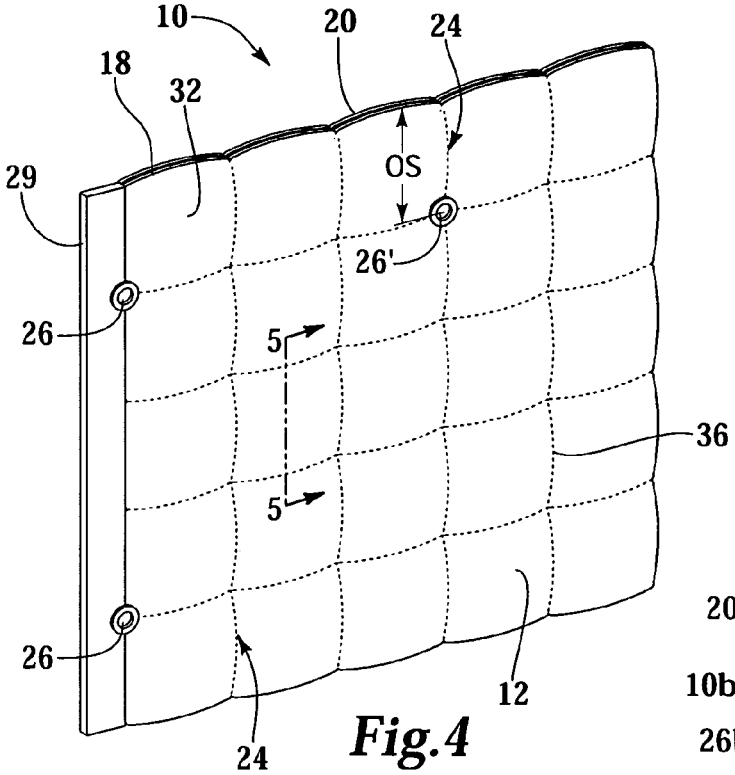
FIG. 4 is a perspective view of the fire-retardant barrier when it is hydrated.

Turning to FIGS. 3, 4, and 6, in one embodiment, barrier 10 includes a pair of sheets 18, 20 of fabric 12 which are joined together in a generally quilted pattern to form the plurality of pockets 14. At least one of the sheets 18, 20, i.e. the sheet 18 that faces outwardly from structure 2 (see FIG. 6), is water-permeable and porous to allow water to pass into or out of pockets 14. Outside sheet 18 can be a woven or a non-woven fabric or another porous material capable of allowing water to pass from one side of sheet 18 to the other. The sheet 20 that faces inwardly toward structure 2 may also be water-permeable.

Sheets 18, 20 should be made from a material that is capable of withstanding the boiling point of water without burning, melting, or degrading. Sheets 18, 20 should be strong enough to physically support superabsorbent polymer 16 and the large amount of water that it can absorb. Water-permeable sheet 18 should also be water-permeable enough to allow water to quickly permeate into pocket cavity 22 so that the step of hydrating barrier 10 (described below) can be done quickly, and to allow water vapor or steam to easily exit cavity 22 to avoid pressure buildup in pockets 14. In one embodiment, sheets 18, 20 are a hydrophilic porous material, including woven materials such as cloth, i.e. cotton, muslin, polyesters, engineered fabrics, porous woven or non-woven synthetic materials or natural materials.

Sheets 18, 20 are joined together by one or more joining elements, such as stitches or staples, wherein the joining elements form pockets 14. Preferably, the joining elements join sheets 18, 20 together so that each pocket 14 is substantially enclosed and isolated from other pockets 14. In one embodiment, shown in FIGS. 2 and 4, sheets 18, 20 are joined together with stitches 24 that form seams 36 around the periphery of each pocket 14.

As described above, it may be desirable to fabricate barrier 10 to a small size that is easy to manipulate. However, because large areas may need to be protected, one or more barriers 10 may be necessary. It may be desirable to overlay portions of the plurality of barriers 10 to form a complete barrier system to cover large areas.

Figure 5:
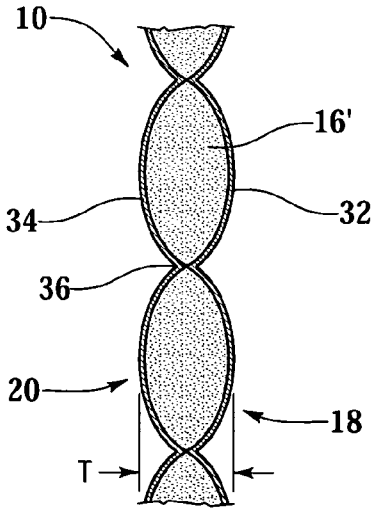
FIG. 5 is a side-sectional view of the hydrated fire-retardant barrier, taken along line 5-5 in FIG. 4.

The amount of space taken up by dry superabsorbent polymer 16 (see FIG. 3) in barrier 10 is small relative to the size of hydrated superabsorbent polymer 16' (see FIG. 5), so that the size of an unhydrated barrier 10 is essentially equal to the size of fabric 12. Similarly, the mass of dry superabsorbent polymer 16 is small relative to the mass of hydrated superabsorbent polymer 16' and the water it has absorbed so that the total mass of dry barrier 10 is essentially the mass of fabric 12. This allows barrier 10 to be easily stored and manipulated, such as by folding barrier 10 into a compact space. The ability to easily store barrier 10 allows a user to store a plurality of barriers 10 in a small space when they are not needed.

Figure 8:
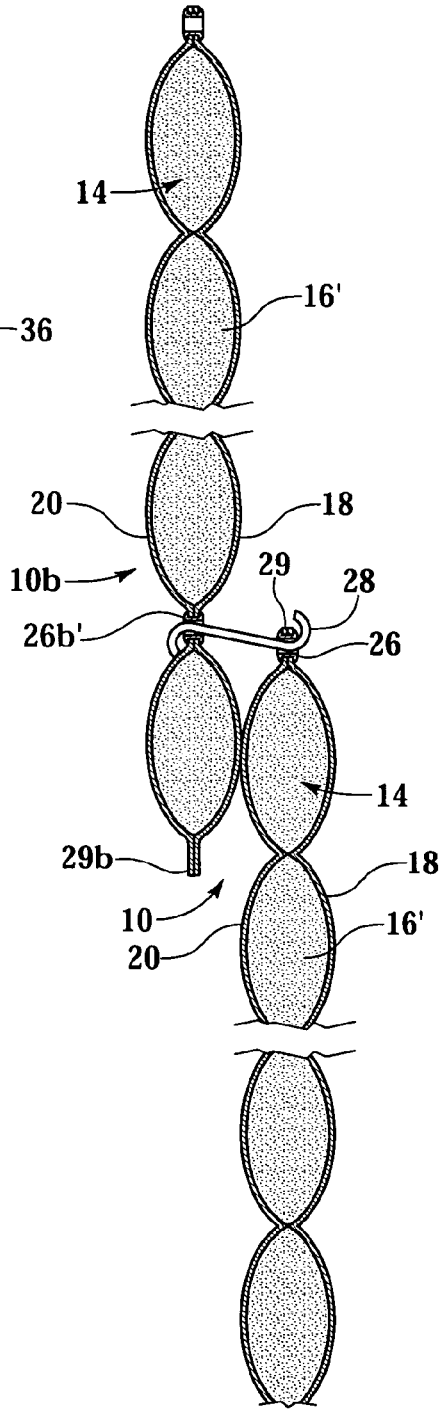
FIG. 8 is a side-sectional view of the fire-retardant barrier fastened to a second fire-retardant barrier with an alternative fastening means.
Figure 7:
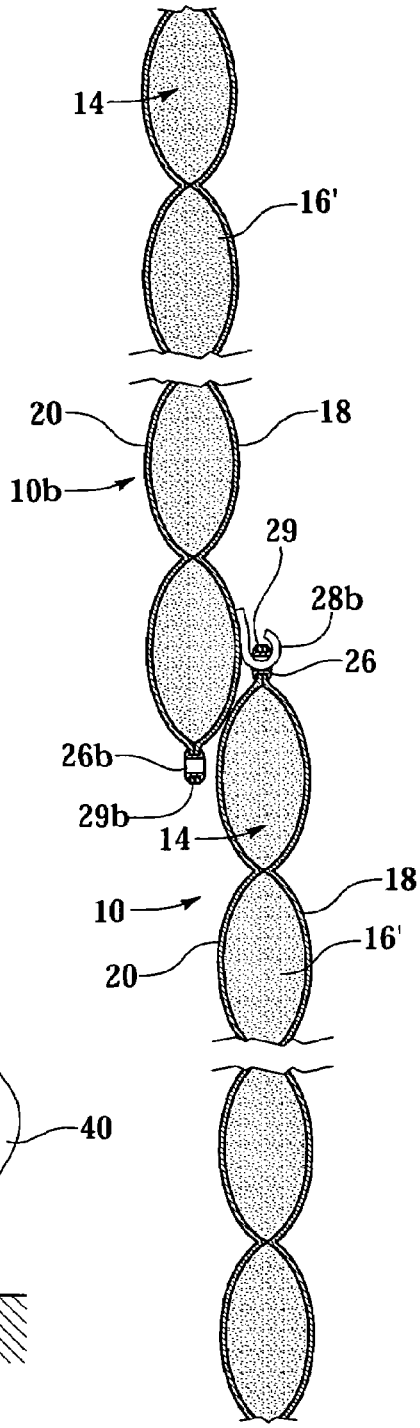
FIG. 7 is a side-sectional view of the fire-retardant barrier fastened to a second fire-retardant barrier.

Turning to FIGS. 7 and 8, it may be desirable for barrier 10 to include means for fastening barrier 10 to another barrier 10*b*, such as a fastener on barrier 10 which engages with a fastener on second barrier 10*b*, so that a plurality of barriers 10, 10*b* can be linked together,.

In one embodiment, shown in FIG. 7, a second barrier 10*b* includes fasteners 28*b*, shown as hook 28*b*, spaced from an edge 29*b* of barrier 10*b*. Spaced fastener 28*b* engages a fastener on barrier 10, shown as an eyelet 26, which can either be at edge 29 of barrier 10, as shown in FIG. 7, or spaced from edge 29. Fasteners spaced from the edge of the barrier allow barrier 10 and second barrier 10*b* to overlap to prevent gaps between barriers 10, 10*b* to reduce the likelihood that sparks, burning debris, hot air, or other components that can ignite structure 2, will bypass barriers 10, 10*b*.

In one embodiment, shown in FIG. 1, barrier 10 includes a plurality of eyelets 26, 26' evenly spaced around the periphery of barrier 10, wherein each eyelet 26, 26' is spaced a predetermined distance ES from adjacent eyelets 26, 26'. The distance ES is small enough to provide support evenly along the length or width of barrier 10. In one embodiment, distance ES is between about 1 inch and about 18 inches, preferably between about 2 inches and about 12 inches, still more preferably about 6 inches.

Figure 2:
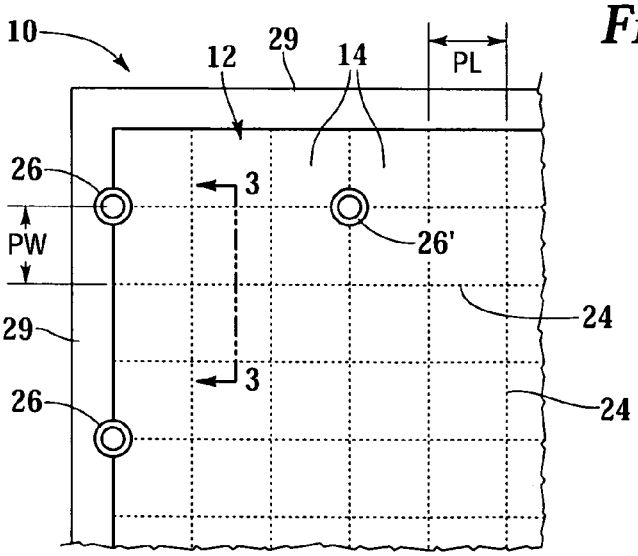
FIG. 2 is an elevation view of the fire-retardant barrier taken along line 2-2 in FIG. 1.

Turning to FIGS. 1, 2, and 8, in another embodiment, barrier 10 includes a first set of eyelets 26 which are positioned proximate edge 29 along two sides of barrier 10 (shown as the left side and the bottom side in FIG. 1) and a second set of eyelets 26' is positioned along the remaining two sides of barrier 10 (shown as the top side and the right side in FIG. 1) which are spaced from edge 29 by a space OS to allow for overlap between barriers. In one embodiment, the overlap spacing distance OS between edge 29 and the second set of eyelets 26' is between about ½ inch and about 6 inches, preferably between about 1 inch and about 4 inches, still more preferably about 2 inches. Second barrier 10*b* also includes first set of eyelets 26*b* (FIG. 7), and second set of eyelets 26*b*' (FIG. 8) which are spaced from edge 29*b*. Barriers 10 and 10*b* are fastened together by overlapping barriers 10, 10*b* so that first eyelets 26 of barrier 10 are aligned with second eyelets 26*b*' of second barrier 10*b*, as shown in FIG. 8. A fastener 28 is inserted through the aligned eyelets 26, 26*b*' so that barriers 10 and 10*b* are fastened together. This process is continued with all the eyelets along each edge 29, 29*b* of barriers 10, and 10*b* so that barrier 10 is connected to second barrier 10*b* along edges 29, 29*b*.

Turning to FIG. 6, barrier 10 can also include means for fastening to structure 2 so that barrier 10 can be mounted and secured to structure 2. The means for fastening to structure 2 can be a fastener included on barrier 10 or on structure 2, such as a hook on barrier 10 (not shown) similar to hook 28*b* (FIG. 7) or an eyelet 26 (FIGS. 1 and 6) for engaging a hook or other fastener 30. The means for fastening barrier 10 to structure 2 can be the same fastener that may be used to fasten barrier 10 to a second barrier 10*b*, as described above, or the means can be a separate fastener.

Other fasteners, such as zippers, Velcro, or pins, may also be used to fasten barriers 10, 10*b* together, or to fasten barrier 10 to structure 2 so long as the fasteners are strong enough to support the weight of a hydrated barrier 10 and the water it holds.

SUPERABSORBENT POLYMER

In order for barrier 10 to be its most efficient in retarding fire from structure 2, barrier 10 should include an absorbent material that can absorb many times its own weight in water. Water-absorbent materials that are capable of absorbing many times their own weight in water usually comprise a polymer or a grafted polymeric compound, usually referred to as superabsorbent polymers, which are known to absorb between about 40 and about 400 times their weight in water. Examples of superabsorbent materials include crosslinked polymers such as polyacrylates and their derivatives, including polyacrylamide and polyacrylate salts, i.e. sodium polyacrylate or potassium polyacrylate, polyacrylate/polyacrylamide copolymers, and starch-grafted polymers. In one embodiment, superabsorbent polymer 16 is made up of small particles which can be easily poured into pockets 14 when barrier 10 is being made. In one embodiment, the particles of superabsorbent polymer 16 are sized between about 500 mesh (about 0.025 mm in diameter) and about 2 mm in diameter.

Polyacrylate salts such as sodium polyacrylate or potassium polyacrylate can absorb up to about 500 times their weight in water, or more. However, because they are salts, their absorption capacity is greatly dependent on the impurities in the water. For example, "hard water," or water with a relatively high concentration of calcium or magnesium ions, lowers the absorption capacity of potassium polyacrylate because the ions disrupt bonding between the polymer and water.

Polyacrylamide is not as affected by hard water, but does not have as high an absorption capacity as the polyacrylate salts. Polyacrylamide is known to be able to absorb between about 20 times and about 400 times its weight in water. However, even at absorption capacities as low as 100 times its weight in water, polyacrylamide can still absorb enough water to be an effective fire-retardant.

Preferably, barrier 10 holds enough water to retard a fire from burning an object until the fire moves away from the object, or until the fire burns out. In one embodiment, superabsorbent polymer 16 in barrier 10 is able to absorb between about 200 pounds and about 4000 pounds of water, preferably between about 260 pounds and about 2500 pounds of water, and still more preferably about 1200 pounds of water. In order to absorb the desired amount of water, between about 2 pounds and about 50 pounds of superabsorbent polymer 16 is included in barrier 10, and preferably between about 2.6 and about 24 pounds, and still more preferably about 11 pounds of superabsorbent polymer 16.

Barrier 10 may also hold between about ½ pound of water per square foot of barrier 10 and about 10 pounds of water per square foot of barrier 10, preferably between about 2 pounds of water per square foot of barrier 10 and about 6 pounds of water per square foot of barrier 10, and still more preferably about 3 pounds of water per square foot of barrier 10. In one embodiment, barrier 10 is about 20 feet long by about 20 feet wide, with a total area of about 400 square feet, and barrier can absorb about 1200 pounds of water, or about 3 pounds of water per square foot.

The amount of superabsorbent polymer 16 that is needed per square foot of barrier 10 is equal to the amount of water desired to be absorbed, divided by the absorption capacity of superabsorbent polymer 16. For example, if it desired that about 3 pounds of water per square foot be absorbed, and a superabsorbent polymer 16 having an absorption capacity of about 100 times its own weight is used, then at least about 0.03 pounds (about 13.6 grams) of superabsorbent polymer per square foot of barrier 10 would be required. In one embodiment, barrier 10 averages between about 3 grams and about 27 grams, preferably between about 8 grams and about 25 grams, and still more preferably about 12.6 grams of superabsorbent polymer 16 per square foot of barrier 10.

POCKETS

Turning back to FIGS. 1-4, in one embodiment, the barrier 10 includes a plurality of pockets 14 connected together to form fire-retardant barrier 10 for covering a substantial area, wherein each one of the plurality of pockets 14 has a pair of fabric layers 32, 34 and a cavity 22 disposed therebetween. Substantially all of the pockets 14 hold a small amount of a superabsorbent polymer 16 in its cavity 22.

At least one of fabric layers 32, 34, i.e. the outer fabric layer 32 relative to structure 2 (see FIG. 6), is water-permeable to allow water to pass into cavity 22. Inner fabric layer 34 may also be water-permeable. Cavity 22 of each pocket 14 has a maximum volumetric capacity of between about 0.03 cubic inches and about 17 cubic inches, preferably between about ½ cubic inch and about 10 cubic inches, still more preferably about 2 cubic inches. Substantially all the pockets 14 contain between about 0.01 grams and about 2 grams of superabsorbent polymer 16 per cubic inch of volumetric capacity of cavity 22, preferably between about 0.05 grams per cubic inch and about 0.33 grams per cubic inch, still more preferably about 0.16 grams of superabsorbent polymer 16 per cubic inch of volumetric capacity.

Stitches 24 form a generally quilted pattern of pockets 14. Stitches 24 can form pockets 14 into any one of several geometric shapes including triangular shapes, quadrilaterals including squares, rectangles, diamonds, parallelograms, and trapezoids, pentagonal shapes, hexagonal shapes, octagonal shapes, circular and ovaloid shapes, or combinations of geometric shapes to form a continuous array of pockets 14 for holding superabsorbent polymer 16. In one embodiment, shown in FIGS. 1 and 2, stitches 24 form a generally quilted pattern of square pockets 14.

In one embodiment, shown in FIGS. 1 and 2, pockets 14 are generally rectangular having a length PL and a width PW, wherein length PL of between about ½ inch and about 4 inches, preferably between about 1 inch and about 3 inches, still more preferably about 2 inches, and a width PW of between about ½ inch and about 4 inches, preferably between about 1 inch and about 3 inches, still more preferably about 2 inches. In one embodiment, pockets 14 are generally square shaped, as shown in FIG. 2, and are about 2 inches long by about 2 inches wide.

In one embodiment, described above, the plurality of pockets 14 are formed by joining two sheets 18, 20 together with one or more joining elements so that pockets 14 are formed between sheets 18, 20, wherein outer water-permeable fabric layer 32 is part of outer fabric sheet 18 and inner fabric layer 34 is part of inner sheet 20. The joining elements, such as stitches 24, segment sheets 18, 20 into fabric layers 32, 34 which form pockets 14 having cavities 22 for holding superabsorbent polymer 16.

In another embodiment, pockets 14 are formed separately from a plurality of fabric layers 32, 34 and connected together, such as by stitching to form seams 36 between adjacent pockets, similar to a patchwork quilt.

When superabsorbent polymer 16 is dry, i.e. no water is absorbed, the total volume occupied by superabsorbent polymer 16 is substantially less than the maximum volumetric capacity of cavity 22 so that layers 32, 34 are slack, see FIG. 3. When water is applied to barrier 10, superabsorbent polymer 16 absorbs the water and expands to a volume that is much larger than its original volume. Eventually, when hydrated superabsorbent polymer 16' absorbs enough water, the polymer expands to fill essentially all of the available volume within cavity 22, pushing layers 32, 34 outwardly so that they are taut and so that pocket 14 forms a generally ellipsoidal shape by expanding cavity 22 to its maximum volumetric capacity, see FIGS. 4 and 5. The ellipsoidal shape of pockets 14 formed by hydrated superabsorbent polymer 16' has a maximum thickness T, see FIG. 5. In one embodiment, pockets 14 have a thickness T of between about ¼ inch and about 4 inches, preferably between about ¾ inch and about 2½ inches, still more preferably about 2 inches.

The maximum volumetric capacity acts to limit the maximum amount of water that a particular pocket can absorb because it limits the volume to which superabsorbent polymer 16 can expand. The expansion force created by superabsorbent polymer 16 against layers 32, 34 is not high enough to break the hold of the joining elements or to tear layers 32, 34. Once hydrated superabsorbent polymer 16' has expanded pocket 14 to its maximum volumetric capacity, layers 32, 34 prevent superabsorbent polymer 16 from expanding further, and therefore prevents the polymer from absorbing any more water. The volumetric capacity of each pocket 14 depends on the cross sectional area of the pocket, i.e. length PL multiplied by width PW for pocket 14 shown in FIG. 2.

Because barrier 10 will be protecting a large area, such as an entire structure 2, it is also desirable for barrier 10 to hold a sufficient amount of water per square foot so that barrier 10 will be able to retard fire evenly across a large area. For this reason, superabsorbent polymer 16 is compartmentalized in pockets 14, as described below, wherein there are a predetermined number of pockets per square foot, with each pocket 14 holding enough superabsorbent polymer 16 so that barrier 10 will absorb the desired amount of water per square foot.

Preferably, superabsorbent polymer 16 is evenly dispersed across barrier 10. In one embodiment, between about 0.001 grams and about 35 grams, preferably between about 0.005 grams and about 3 grams, still more preferably about 0.35 grams of superabsorbent polymer 16 is placed in each pocket 14. If barrier 10 includes a plurality of pockets 14 each having essentially the same volumetric capacity, such as square pockets 14 shown in FIG. 2, then an equal amount of superabsorbent polymer 16 should be placed in each pocket 14. However, if there are pockets having different sizes, for example a quilted pattern of square pockets and hexagonal pockets, than more superabsorbent polymer 16 will be placed in larger-sized pockets than in relatively smaller-sized pockets.

It was expected that if a flammable fabric 12 were used, a fire would contact surface 21 of fabric 12, and the intense heat would quickly evaporate the water at surface 21, drying fabric 12. It was then expected that the dry fabric 12 would ignite and burn away, causing superabsorbent polymer 16 to fall out of barrier 10. If this did not occur, the other expected result was that the fire would quickly evaporate all the water from superabsorbent polymer 16, which is also combustible, and that both fabric 12 and superabsorbent polymer 16 would burn.

Surprisingly, it has been found that barrier 10 does not go through this mode of action. Rather, it has been found that barrier 10 goes through the unexpected process of the fire heating the water, superabsorbent polymer 16, and fabric 12 so that steam is generated at surface 21 of barrier 10. The steam forms a steam layer 38 which acts as a fire extinguisher to prevent fabric 12 from igniting by displacing oxygen to quench any flame 40 that may try to form at surface 21 so that barrier 10 is self-protecting. The water absorbed in barrier 10 also absorbs a large amount of heat from the fire and keeps barrier 10 at the boiling point of water, 100° C.

METHOD

A method of retarding fire is also provided having the steps of providing a plurality of fire-retardant barriers 10, covering substantially all of an object, such as a structure 2, with the plurality of fire-retardant barriers 10, and hydrating superabsorbent polymer 16 in each one of the plurality of fire-retardant barriers 10.

If it is believed that a fire will encounter a particular object, a plurality of fire-retardant barriers 10 can be used to cover the object. Covering an object, i.e. a structure 2 such as the house shown in FIG. 9, may include the steps of placing barriers 10 on the roof of structure 2 in order to cover the roof, fastening barriers 10 together so that the plurality of barriers 10 form a generally continuous cover for covering substantially all of the roof, and hanging barriers 10 off the roof so that they hang down to the ground to cover substantially all of the walls of structure 2. Barriers 10 can be hung so that the bottom edge of the barrier is even with the ground (as with barrier 10*d* in FIG. 9), spaced from the ground, or the barrier may extend beyond the base of structure 2 so that a portion of the barrier lies on the ground (as with barrier 10*e* in FIG. 9) to help prevent spaces between barrier 10 and the ground from forming through which flames can pass. After barriers 10 have been placed on the roof and hung down to cover the walls, substantially all of structure 2 should be covered.

Figure 9:
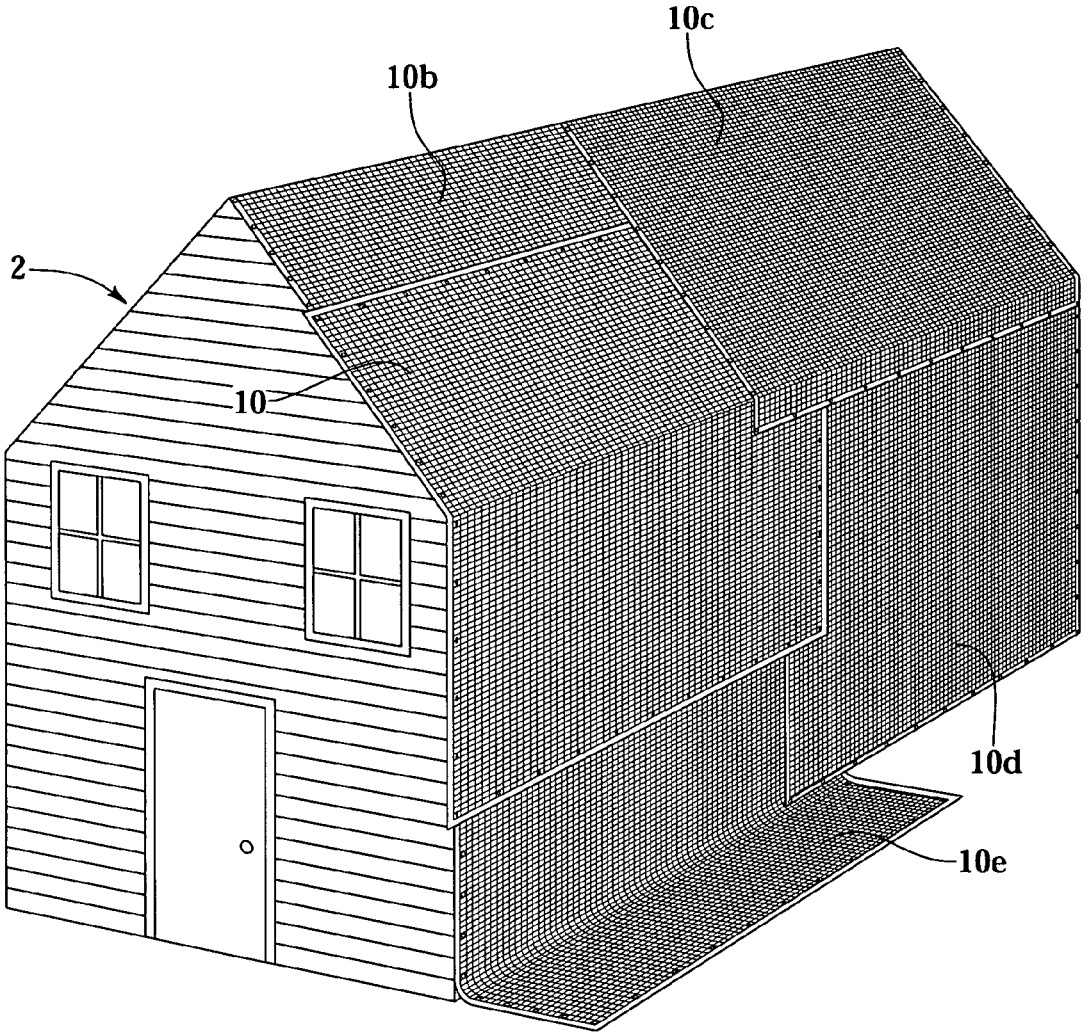
FIG. 9 is a perspective view of a plurality of fire-retardant barriers covering the structure.

The step of hanging barriers 10 to cover structure 2 can be accomplished either by fastening barriers 10 directly to structure 2 or by fastening them to the barriers 10 that have been laid on the roof. Barriers 10 can be laid on structure 2, as shown in FIG. 9, so that barriers 10 lie across the roof of the building and hang down over the exterior walls. Barriers 10 can also be fastened directly to structure 2, see FIG. 6. In one method, substantially all of the barriers 10 are fastened to structure 2 so that barriers 10 are not required to be fastened to one another. Fastening barriers 10 to structure 2 can be accomplished with fasteners 28 on barrier 10, or separate fasteners 30 connecting structure 2 to barrier 10, such as hooks 30 that are received by eyelets 26 on barrier 10, as shown in FIG. 6.

The method can also include the step of fastening the plurality of barriers 10 together, such as with fasteners, including hooks 28*b* or eyelets 26 as shown in FIG. 7. Fastening barriers 10 together can include covering a portion of structure 2 with a first barrier 10*a* followed by connecting a second barrier 10*b* to first barrier 10*a*, such as with fasteners. A third barrier 10*c* can be connected either to first barrier 10*a*, second barrier 10*b*, or a portion of third barrier 10*c* can be connected to first barrier 10*a* while another portion is connected to second barrier 10*b*. This process can be repeated with additional barriers until substantially all of building is covered. The plurality of barriers 10 can also be laid out to cover the desired area and then fastened together. Barriers 10, 10*a*, 10*b*, 10*c* may be overlapped, as shown in FIGS. 6-9 to ensure that burning materials or hot air do not bypass the barriers and ignite structure 2.

Hydrating superabsorbent polymer 16 can be accomplished by spraying water onto barriers 10 so that the sprayed water is absorbed by the superabsorbent polymer 16. No special equipment is needed to spray water on barriers 10. For example, a garden hose may be sufficient. In some cases, it may be desirable to provide enough water pressure to ensure the water can reach the roof of structure 2 from the ground, such as with a water booster pump, so that an operator of the hose or sprayer does not have to climb a ladder during the rushed operation of hydrating barriers 10 while a fire is bearing down on structure 2. Barrier 10 can also be rehydrated as the fire evaporates the water out of barrier 10 by reapplying water to barrier 10 to prolong the life of barrier 10.

Because of its absorbent nature, superabsorbent polymer 16 absorbs the sprayed water quickly so that the step of hydrating barriers 10 in a relatively short operation. This allows a home owner or building maintenance person to cover structure 2 with barriers 10 well before a fire is expected, but wait to hydrate barriers 10 until they are more certain a fire will come into contact with structure 2. Because of the large amount of water superabsorbent polymer 16 can absorb, a barrier 10 that has been hydrated is heavy and difficult to manipulate. For example, when barrier 10 has a total of 3600 pockets, each holding about 3 grams of superabsorbent polymer 16, the total hydrated weight of barrier 10 is about 2400 pounds, making it difficult to move barrier 10 once it has been hydrated. The ability of a home owner or building maintenance person to wait to hydrate barrier 10 until they are sure it is necessary is particularly advantageous because a user will most likely wish to avoid hydrating barrier 10 unless a fire is fairly certain to pass through, making hydration necessary to protect structure 2.

One method of removing barriers 10 from structure 2 is by opening pockets 14 so that hydrated superabsorbent polymer 16' falls out of cavities 22. Hydrated superabsorbent polymer 16' is biodegradable so that it can be disposed of safely, or so that it can be left out to degrade onto soil. Pockets 14 can be opened by cutting open pockets 14, such as by slicing or tearing layers 32, 34 or stitches 24, or pockets 14 can be made to be openable and reclosable, such as with zippers or other means. After superabsorbent polymer 16' is removed from pockets 14, fabric 12 of barrier 10 can be removed by lifting it off structure 2. Another method of removing barriers includes cutting barrier 10 along stitches 24 in order to remove entire rows of pockets 14 at a time.

In another method, a plurality of barriers 10 are used as a firebreak to prevent the spread of a fire through brush or other flammable material. This method includes placing a first barrier 10 on the material to be protected, placing a second barrier 10 adjacent to the first barrier 10, placing a third barrier 10 adjacent to the second barrier 10, etc. Subsequent barriers 10 are continuously laid onto the material to be protected until the desired area is covered. After the barriers 10 are placed, the step of hydrating the superabsorbent polymer 16 in the barriers 10 is carried out. Hydrating the barriers 10 can commence after all the barriers 10 have been placed, or hydrating can be performed while barriers 10 are still being placed to ensure rapid deployment of the firebreak.

The apparatus and method of using barrier 10 are exemplified in the following examples, which are in no way limiting of the scope of the present invention.

EXAMPLE 1

Two small, substantially identical piles of wood two-by-twos, or "houses," are erected proximate each other on a grass field. One house is an experimental house which is to be protected by a fire-retardant barrier and the other is a control house which is to be left unprotected. Each house is constructed from 18 two inch-by-two inch wood blocks, each block being about 6 inches long. The blocks are stacked into 3 levels, with each level comprising 6 blocks arranged in a 3 block by 2 block grid with air spaces in between. The two-by-two blocks of the houses are labeled and weighed individually to determine if there is any weight loss due to burning during the experiment.

Two fire-retardant barriers are provided, each barrier being about 24 inches by about 22.5 inches and including two sheets of cotton muslin fabric sewed together with stitches. The stitches form a quilted pattern of substantially rectangular pockets arranged 9 pockets long by 6 pockets wide, wherein each pocket is about 2.5 inches by about 4 inches. Each pocket holds about 1 gram of superabsorbent polyacrylamide polymer that is in the form of generally spherical particles having a diameter of about 0.25 mm.

The barriers are soaked in water in order to fully hydrate the superabsorbent polyacrylamide polymer. After soaking the barriers, they are placed over the experimental house, with one barrier overlapping a portion of the other, while the control house remains uncovered.

Two 75 pound bales of dry straw are uniformly spread over and around the control house and the experimental house. The straw is spread evenly around and on top of both the protected experimental house and the control house. The straw is ignited and allowed to burn for a 90 minute observation period.

After the 90 minute observation period, residual ash from the burned straw is removed from around the houses. The control house, i.e. the house not covered by a fire-retardant barrier, is completely burned and reduced essentially to embers and ash.

The fire-retardant barriers are removed from the experimental house and examined. The outer sheet of the barrier appears to be sooted by the ash from the burning straw and is darker in color, but otherwise the barriers are undamaged and intact. There is an absence of any singeing on the outer sheet. The wood two-by-twos used to construct the experimental house surprisingly are totally unaffected by the fire. In addition to the wood two-by-twos of the experimental house being protected from the fire during the experiment, it was noted that the grass that was around the control house had been charred and blackened, but that the grass that had been underneath the barrier was unburned and still green.

The weights of the blocks of the unprotected control house before and after the experiment are shown in the following table:

| Block # | Weight Before Fire (grams) | Weight After Fire (grams) | Block # | Weight Before Fire (grams) | Weight After Fire (grams) |
|---|---|---|---|---|---|
| 1 | 118.22 | * | 10 | 118.39 | * |
| 2 | 117.36 | * | 11 | 117.87 | * |
| 3 | 118.10 | * | 12 | 118.70 | * |
| 4 | 118.93 | * | 13 | 117.98 | * |
| 5 | 118.38 | * | 14 | 117.79 | * |
| 6 | 119.01 | * | 15 | 118.18 | * |
| 7 | 118.65 | * | 16 | 118.73 | * |
| 8 | 117.68 | * | 17 | 118.56 | * |
| 9 | 118.22 | * | 18 | 118.63 | * |

The weight of each block after the fire is indicated as a * to show that all that remained of each block was ashes and embers, which were not weighed.

The 18 two-by-two blocks of the experimental house are weighed individually to determine any weight change during the experiment. The weights of the blocks of the protected experimental house are shown in the following table:

| Block # | Weight Before Fire (grams) | Weight After Fire (grams) | Block # | Weight Before Fire (grams) | Weight After Fire (grams) |
|---|---|---|---|---|---|
| 1 | 118.89 | 118.93 | 10 | 118.43 | 118.47 |
| 2 | 118.12 | 118.23 | 11 | 118.76 | 118.80 |
| 3 | 117.97 | 117.91 | 12 | 118.22 | 118.26 |
| 4 | 119.01 | 119.02 | 13 | 118.29 | 118.32 |
| 5 | 118.56 | 118.53 | 14 | 117.87 | 118.90 |
| 6 | 116.99 | 116.99 | 15 | 117.89 | 117.86 |
| 7 | 117.87 | 117.78 | 16 | 118.58 | 118.54 |
| 8 | 117.80 | 117.82 | 17 | 118.29 | 118.34 |
| 9 | 118.67 | 118.69 | 18 | 118.89 | 118.86 |

EXAMPLE 2

A plurality of fire-retardant barriers is used to protect a 75 foot by 40 foot (3000 square foot) house. Each fire-retardant barrier is 20 feet 2 inches long by 20 feet 2 inches wide to allow for 20 foot by 20 foot coverage per barrier with an overlap of 2 inches along the periphery of each barrier. The barrier includes 14,641 pockets that are 2 inches by 2 inches. Each pocket has a volume of about 35 $cm^3$ so that the water absorbed into each pocket weighs about 35 grams. 0.35 grams of superabsorbent polymer is placed in each pocket so that there is a total of about 11.3 pounds of superabsorbent polymer per barrier. The total weight of each barrier before hydration is about 20 pounds. The total weight of each barrier after hydration is about 1,140 pounds, so that each barrier has a weight of about 2.85 pounds per square foot. A total of 26 barriers are used to cover the roof and the walls of the house.

The plurality of barriers are applied to the house by placing a folded first barrier on the roof, followed by unfolding the first barrier, placing a second barrier adjacent to the first barrier and unfolding the second barrier, and ensuring that about 2 inches of the second barrier overlaps the first barrier. Subsequent barriers are placed on the roof in substantially the same manner until substantially all the roof is covered, after which the barriers are fastened together. Additional barriers are hung off the edge of the roof to cover the walls of the house. The barriers can be hung off the roof by either fastening the hanging barriers to the barriers that already are placed on the roof, or by fastening the hanging barriers directly to the house. After substantially the entire house is covered, the user hydrates the barriers with a garden house until all of the barriers are hydrated.

As described above, steam is formed by volatilizing the water absorbed by the barrier, and the steam helps to extinguish the fire at the barrier. The volume of steam generated can be approximated using the ideal gas law:

$$V = \frac{mRT}{MW}$$

wherein V is the volume of steam formed, m is the mass of the steam formed, R is a constant which is approximately 0.082 atmospheres-liter/(° Kelvin-mole), T is the temperature in ° K, which will be the boiling point of water, or 373° K, and MW is the molecular weight of water, or 18 grams/mole.

Therefore, each superabsorbent polymer filled pocket, which holds 35 grams of water, can liberate about 59.5 liters of steam before the water is exhausted. Each barrier of 14,641 pockets can liberate a total of about 871,000 liters of steam, and the total system of 26 barriers can liberate about 2,265,000 liters of steam.

As the steam is formed, the water absorbs heat from the fire. The heat absorbed by the water can be approximated by a change in enthalpy calculation:

$$\Delta H=H_1+[C_p(2)-C_p(1)]*(T_2-T_1)$$

wherein ΔH is the heat absorbed in calories, $T_1$ is the initial temperature of the water, assumed to be about 25° C., or 298° K, $T_2$ is the final temperature of the steam, assumed to be 100° C., or 373° K, $C_p(1)$ is a constant of 1.0 calories/(° K-gram) for water, $C_p(2)$ is a constant of 0.444 calories/(° K-gram) for steam, and $H_1$ is the heat of vaporization of water, which is 539.7 calories/gram.

Therefore, each gram of water in the barrier can absorb about 498 calories of heat from the fire as it is vaporized into steam. Each superabsorbent polymer filled pocket holds about 35 grams of water, so that each pocket can absorb about 17,430 calories of heat, or about 69.2 BTU. Each barrier of 14,641 pockets can absorb about 255,200,000 calories, or about 1,013,000 BTU of heat, and the entire system of 26 barriers can absorb about 663,500,000 calories, or about 26,340,000 BTU of heat from the fire before the water is exhausted.

EXAMPLE 3

A plurality of fire-retardant barriers is used as a firebreak in an area that is heavily covered by scrub brush and other combustible biological material. Each barrier is about 100 feet long by 50 feet wide and allows for about 2.5 feet on each side for overlap, providing a linear coverage of about 95 feet. Each pocket is 1.5 inches by 1.5 inches so that there are a total of 320,000 pockets. Each pocket has a volumetric capacity of about 15 $cm^3$. 0.15 grams of superabsorbent polymer is placed in each pocket, and each pocket is capable of absorbing about 15 grams of water. The weight of the superabsorbent polymer per barrier is about 105 pounds. The weight of each barrier before hydration is about 150 pounds, and the weight of the barrier after hydration is about 10,600 pounds. In order to cover a linear distance of about 5 miles, 278 barriers are required.

The firebreak is put together by fire fighters or other users by placing a first folded barrier on the scrub brush and unfolding the barrier out to its full length and width, followed by placing a second barrier adjacent to the first barrier so that about 2.5 feet of the length of the second barrier overlaps the first barrier, then unfolding the second barrier to its length and width. The process is repeated with subsequent barriers until substantially all of the 5 miles is covered by the plurality of barriers. Hydrating the barriers can be accomplished with a tank wagon, an airplane, a nearby river or reservoir, or another source of water large enough to hydrate the barriers. The barriers can be hydrated after they have all been placed along the five miles of firebreak, or the barriers can be hydrated as they are placed in position to ensure rapid deployment.

The barriers of the firebreak produce steam as they are heated. The ideal gas law, described above, is used to approximate the amount of steam created. Each superabsorbent polymer filled pocket of the firebreak barriers can liberate about 25.5 liters of steam so that each barrier can liberate about 8,160,000 liters of steam, and the entire firebreak of 278 barriers can liberate about 2,270,000,000 liters of steam before the water is exhausted.

By approximating the heat absorbed using a change in enthalpy calculation, described above, it was determined that each pocket of the firebreak barriers can absorb about 7,470 calories, or about 29.7 BTU of heat, so that each barrier can absorb about 2,390,000,000 calories, or about 9,490,000 BTU of heat from the fire, and the entire firebreak can absorb about 664,500,000,000 calories, or about 2,638,000,000 BTU of heat from the fire before the water is exhausted.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A self-protecting barrier system for retarding fire comprising:

a fire-retardant barrier having a water-permeable first fabric covering a substantial area;

said first fabric having a surface and said fire-retardant barrier having at least 9 pockets per square foot, each pocket having a volumetric capacity of between about 0.03 cubic inches and about 17 cubic inches, wherein substantially all of said pockets contain superabsorbent polymer in the amount of between about 0.01 and about 2 grams unhydrated weight of superabsorbent polymer per cubic inch of said volumetric capacity of said pockets; and said superabsorbent polymer upon hydration with water forming a substantially continuous matrix of hydrated superabsorbent polymer which substantially fills said volumetric capacity of said pockets.

2. A self-protecting barrier system according to claim 1, wherein said superabsorbent polymer is a polyacrylate or a polyacrylate derivative.

3. A self-protecting barrier system according to claim 1, wherein said superabsorbent polymer is polyacrylamide.

4. A self-protecting barrier system according to claim 1, wherein each one of said pockets when the superabsorbent polymer is unhydrated is between about ½ inch and about 5 inches long and between about ½ inch and about 5 inches wide.

5. A self-protecting barrier system according to claim 1, where each of said pockets holds between about 0.005 grams and about 3 grams unhydrated weight of said superabsorbent polymer.

6. A self-protecting barrier system according to claim 1, further comprising means capable of fastening said fire-retardant barrier to a building.

7. A self-protecting barrier system according to claim 6, wherein said first fabric is porous, hydrophilic and flammable and said superabsorbent polymer is a polyacrylate or a polyacrylate derivative.

8. A self-protecting barrier system according to claim 6, wherein said first fabric is porous, hydrophilic and flammable and said superabsorbent polymer is polyacrylamide.

9. A self-protecting barrier system according to claim 1, further comprising fasteners capable of fastening said fire-retardant barrier to a building.

10. A self-protecting barrier system according to claim 9, wherein said first fabric is porous, hydrophilic and flammable and said superabsorbent polymer is a polyacrylate or a polyacrylate derivative.

11. A self-protecting barrier system according to claim 9, wherein said first fabric is porous, hydrophilic and flammable and said superabsorbent polymer is polyacrylamide.

12. A self-protecting barrier system comprising:

a fire-retardant barrier having a water-permeable first fabric covering a substantial area;

said first fabric having a surface and said fire-retardant barrier having at least 9 pockets per square foot, each pocket having a volumetric capacity of between about 0.03 cubic inches and about 17 cubic inches, wherein substantially all of said pockets contain superabsorbent polymer in the amount of between about 0.01 and about 2 grams unhydrated weight of superabsorbent polymer per cubic inch of said volumetric capacity of said pockets, said superabsorbent polymer upon hydration with water substantially filling said volumetric capacity of said pockets and a second fire-retardant barrier and means for fastening said fire-retardant barrier to said second fire-retardant barrier.

13. A self-protecting barrier system according to claim 12, wherein said first fabric is porous, hydrophilic and flammable and said superabsorbent polymer is a polyacrylate or a polyacrylate derivative.

14. A self-protecting barrier system according to claim 12, wherein said first fabric is porous, hydrophilic and flammable and said superabsorbent polymer is polyacrylamide.

15. A self-protecting barrier system comprising a fire-retardant barrier having a water-permeable first fabric covering a substantial area;

said first fabric having a surface and said fire-retardant barrier having at least 9 pockets per square foot, each pocket having a volumetric capacity of between about 0.03 cubic inches and about 17 cubic inches, wherein substantially all of said pockets contain superabsorbent polymer in the amount of between about 0.01 and about 2 grams unhydrated weight of superabsorbent polymer per cubic inch of said volumetric capacity of said pockets;

said superabsorbent polymer upon hydration with water substantially filling said volumetric capacity of said pockets, and a second fire-retardant barrier and fasteners for fastening said fire-retardant barrier to said second fire-retardant barrier.

16. A self-protecting barrier system according to claim 15, wherein said first fabric is porous, hydrophilic and flammable and said superabsorbent polymer is a polyacrylate or a polyacrylate derivative.

17. A self-protecting barrier system according to claim 15, wherein said first fabric is porous, hydrophilic and flammable and said superabsorbent polymer is polyacrylamide.

18. A self-protecting barrier for retarding fire, comprising:

a plurality of pockets connected together to cover a substantial area;

wherein each one of said plurality of pockets has a a first fabric layer and a second fabric layer, wherein said first fabric layer is water-permeable, and a cavity disposed between said first and second fabric layers, said cavity having a capacity of between about 0.03 cubic inches and about 17 cubic inches;

wherein substantially all of said plurality of pockets are substantially slack and hold substantially only loose superabsorbent polymer in the amount of between about 0.01 and about 2 grams of said superabsorbent polymer per cubic inch of volumetric capacity.

19. A self-protecting barrier according to claim 18, wherein said first fabric is porous, hydrophilic and flammable and said superabsorbent polymer is a polyacrylate or a polyacrylate derivative.

20. A self-protecting barrier according to claim 18, wherein said first fabric is porous, hydrophilic and flammable and said superabsorbent polymer is polyacrylamide.

21. A self-protecting barrier according to claim 18, wherein each one of said pockets is between about ½ inch and about 5 inches long and between about ½ inch and about 5 inches wide.

22. A self-protecting barrier according to claim 18, where each of said pockets holds between about 0.005 grams and about 3 grams of said superabsorbent polymer.

23. A self-protecting barrier according to claim 18, wherein said second fabric layer is water-permeable.

24. A method of retarding fire from burning an object, comprising the steps of:

providing a plurality of self-protecting fire-retardant barriers, each having water-permeable fabric, said fabric having at least 9 pockets per square foot, each pocket having a volumetric capacity of between about 0.03 cubic inches and about 17 cubic inches, wherein substantially all of said pockets contain between about 0.01 and about 2 grams of superabsorbent polymer per cubic inch of said volumetric capacity of said pockets;

covering substantially all of said object with said plurality of self-protecting fire-retardant barriers; and hydrating said superabsorbent polymer in each one of said plurality of self-protecting fire-retardant barriers with a sufficient amount of water to expand said superabsorbent polymer to substantially fill said volumetric capacity with a substantially continuous matrix of hydrated superabsorbent polymer and push said pockets out to tautness.

25. A method according to claim 24, further comprising the step of fastening said plurality of self-protecting fire-retardant barriers together for covering substantially all of said object.

26. A method according to claim 24, further comprising the step of evaporating or boiling a portion, of said water of said substantially continuous matrix of hydrated superabsorbent polymer at a temperature of about 100° C. to form a steam layer at a surface of said barriers for protecting said barriers from a fire.

27. A method according to claim 26, further comprising the step of quenching fire with said steam layer.

28. A method of isolating fuel from the flames of a fire, comprising the steps of:

providing at least one self-protecting fire-retardant barrier between said fuel and said flames, said barrier having a first surface facing and exposed to said flames formed of a water-permeable fabric, said fabric having at least 9 pockets per square foot, each pocket having a volumetric capacity of between about 0.03 cubic inches and about 17 cubic inches, wherein substantially all of said pockets contain a substantially continuous matrix of water and hydrated superabsorbent polymer in the amount of between about 0.01 and about 2 grams unhydrated weight of superabsorbent polymer per cubic inch of said volumetric capacity of said pockets, said superabsorbent polymer being hydrated with said water;

volatilizing a portion of said water at a temperature of about 100° C. to form a steam layer at said first surface of said barrier; and deterring ignition of said fabric and preventing said flames from reaching said fuel by substantially extinguishing said flames with said steam layer.

29. A method according to claim 28, further including the steps of dissipating said steam layer, and then removing said barrier.

* * * * *